US009382097B2

(12) United States Patent
Nagata

(10) Patent No.: US 9,382,097 B2
(45) Date of Patent: Jul. 5, 2016

(54) ELEVATOR INFORMATION DISPLAY DEVICE

(75) Inventor: Ayako Nagata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 304 days.

(21) Appl. No.: 14/346,846

(22) PCT Filed: Nov. 25, 2011

(86) PCT No.: PCT/JP2011/077169
§ 371 (c)(1),
(2), (4) Date: Mar. 24, 2014

(87) PCT Pub. No.: WO2013/076864
PCT Pub. Date: May 30, 2013

(65) Prior Publication Data

US 2014/0216859 A1 Aug. 7, 2014

(51) Int. Cl.
*B66B 1/34* (2006.01)
*B66B 3/00* (2006.01)

(52) U.S. Cl.
CPC ..... *B66B 3/002* (2013.01); *B66B 3/006* (2013.01); *B66B 3/008* (2013.01)

(58) Field of Classification Search
CPC ..... B66B 3/002; B66B 3/006; B66B 3/008
USPC ..... 187/247, 380–389, 391, 396
See application file for complete search history.

(56) References Cited

U.S. PATENT DOCUMENTS 4,852,696 A * 8/1989 Fukuda ..... B66B 3/008 187/392
5,056,629 A * 10/1991 Tsuji ..... B66B 3/00 187/396

(Continued)

FOREIGN PATENT DOCUMENTS

JP 61 136887 6/1986
JP 62 205978 9/1987

(Continued)

OTHER PUBLICATIONS

International Preliminary Report on Patentability and Written Opinion issued Jun. 19, 2014 in PCT/JP2011/077169 (submitting English translation only).

(Continued)

*Primary Examiner* — Anthony Salata
(74) *Attorney, Agent, or Firm* — Oblon, McClelland, Maier & Neustadt, L.L.P

(57) ABSTRACT

An elevator information display device including: an information display control section that selects, based on an elevator state, information to be displayed from elevator information and general information, interrupts, when a predetermined display interruption factor occurs during display of general information, display of the general information concerned, and displays the elevator information; a display state administration section that determines whether or not the general information has finished being displayed to the end of the information display unit; and a redisplay determination section that determines, when the display of general information has been interrupted, based on the display interruption factor relating to the interruption and the result of the determination, whether or not the redisplay of the interrupted general information is necessary, wherein the information display control section redisplays the general information, which has been determined to be necessary to be redisplayed, from the beginning of the information display unit.

12 Claims, 3 Drawing Sheets

1 :INFORMATION DISPLAY DEVICE BODY
2 :INFORMATION DISPLAY SECTION
3 :INFORMATION DISPLAY CONTROL SECTION
3a:REDISPLAY DETERMINATION SECTION
4 :ELEVATOR INFORMATION STORAGE SECTION
5 :GENERAL INFORMATION STORAGE SECTION
6 :ELEVATOR CONTROL DEVICE
6a:ELEVATOR INFORMATION CONTROL SECTION
7 :DISPLAY STATE ADMINISTRATION SECTION

(56) References Cited

U.S. PATENT DOCUMENTS

| | | | | |
|---|---|---|---|---|
| 5,307,903 | A * | 5/1994 | Morita | B66B 1/18 187/380 |
| 5,844,181 | A * | 12/1998 | Amo | B66B 1/34 187/247 |
| 6,073,727 | A * | 6/2000 | DiFranza | B66B 1/34 187/247 |
| 6,304,257 | B1 * | 10/2001 | Viskari | B66B 5/0006 187/241 |
| 6,349,797 | B1 * | 2/2002 | Newville | B66B 1/34 187/391 |
| 6,578,675 | B2 * | 6/2003 | Wilson | B66B 3/008 187/247 |
| 8,065,155 | B1 * | 11/2011 | Gazdzinski | G06Q 30/0251 369/24.01 |
| 8,496,091 | B2 * | 7/2013 | Wu | B66B 3/00 187/391 |
| 8,688,664 | B2 * | 4/2014 | Pineau | G06F 17/30371 187/391 |
| 2003/0192746 | A1 * | 10/2003 | Suzuki | B66B 5/0037 187/391 |

FOREIGN PATENT DOCUMENTS

| | | |
|---|---|---|
| JP | 64 59598 | 3/1989 |
| JP | 5 319714 | 12/1993 |
| JP | 7-225576 A | 8/1995 |
| JP | 2001 206655 | 7/2001 |
| JP | 3426966 | 7/2003 |
| JP | 2004 80447 | 3/2004 |
| JP | 2008 134581 | 6/2008 |
| JP | 2011 197576 | 10/2011 |

OTHER PUBLICATIONS

International Search Report Issued Feb. 14, 2012 in PCT/JP11/077169 Filed Nov. 25, 2011.

Japanese Office Action issued Dec. 16, 2014 in Patent Application No. 2013-545737 (with Partial English Translation).

* cited by examiner

1 :INFORMATION DISPLAY DEVICE BODY
2 :INFORMATION DISPLAY SECTION
3 :INFORMATION DISPLAY CONTROL SECTION
3a:REDISPLAY DETERMINATION SECTION
4 :ELEVATOR INFORMATION STORAGE SECTION
5 :GENERAL INFORMATION STORAGE SECTION
6 :ELEVATOR CONTROL DEVICE
6a:ELEVATOR INFORMATION CONTROL SECTION
7 :DISPLAY STATE ADMINISTRATION SECTION

ELEVATOR INFORMATION DISPLAY DEVICE

TECHNICAL FIELD

The present invention relates to an elevator information display device.

BACKGROUND ART

In some of conventional elevator information display device, to alleviate the user's irritation and displeasing feelings caused by waiting time in an elevator hall, a sense of oppression in a car, or the like, general information such as current news and weather forecasts is displayed in addition to the elevator information concerning the elevator.

As the above-described conventional elevator information display device that displays elevator information and general information, there have been known an information display device in which when the elevator car stops at a car call registration floor, only the elevator information such as floor information is displayed, and the general information is not displayed (for example, refer to Patent Literature 1), and an information display device in which the elevator information is classified into control information and guidance information according to the degree of importance, and within the information reporting time, the general information is displayed in preference to the guidance information (for example, refer to Patent Literature 2).

Also, as the conventional elevator information display device that scroll-displays the general information, there have been known an information display device in which elevator running time and general information display time are compared with each other, and if the elevator running time is shorter, the scroll speed is increased, and the information display is finished until the car arrives at the destination floor, whereby the offering of general information is prevented from being omitted (for example, refer to Patent Literature 3), and an information display device in which, in a system in which the same information is scroll-displayed on the information display devices installed in the hall and the car, during the time when users are getting into and out of the car, the scroll display is stopped temporarily, and the scroll is restarted after users have gotten into and out of the car, whereby the users can ascertain the display contents uninterruptedly even if they go between the hall and the car (for example, refer to Patent Literature 4).

CITATION LIST

Patent Literature

Patent Literature 1: Japanese Patent Laid-Open No. 62-205978

Patent Literature 2: Japanese Patent Laid-Open No. 2001-206655

Patent Literature 3: Japanese Patent Laid-Open No. 61-136887

Patent Literature 4: Japanese Patent Laid-Open No. 05-319714

SUMMARY OF INVENTION

Technical Problem

Unfortunately, the conventional elevator information display device described in Patent Literature 1 has a problem that, for the users who do not get into and out of the car at the service floor, the display of general information is stopped unexpectedly, so that there is a possibility that these users may feel dissatisfied with the omission of offering of general information or the unexpected interruption of information display that they have been seeing.

Also, the conventional elevator information display device described in Patent Literature 2 has a problem that, for a time period other than preset information reporting time, the degree of priority of the display of general information is set low, so that the display of general information is interrupted, and therefore there is a high possibility that the offering of information may be omitted.

Further, the conventional elevator information display device described in Patent Literature 3 has a problem that, in the case where the amount of information to be displayed is large, the scroll speed becomes too high because all pieces of information are displayed, so that the readability is impaired.

The conventional elevator information display device described in Patent Literature 4 has a problem that, for the users who do not get into and out of the car at the service floor, the scroll display of general information that they have been seeing is stopped unexpectedly, so that there is a possibility that these users may feel dissatisfied, and also has a problem that, in the case where the time during which the scroll display is stopped becomes long, these users forget the content having been displayed, and when the scroll display is restarted, the content of scroll-displayed information may become incomprehensible to these users.

The present invention has been made to solve the above-described problems, and accordingly an object thereof is to provide an elevator information display device having a possibility that, according to the operation state of elevator, the display of general information is interrupted, and elevator information is displayed preferentially, and capable of preventing the offering of general information to users from being omitted and of lightening the dissatisfaction that may be felt by the user on account of the interruption of display of general information.

Means for Solving the Problems

An elevator information display device according to the present invention, which displays elevator information and general information, which is divided into information display units, in an information display section, comprises: an information display control section which selects, based on the state of an elevator, information to be displayed in the information display section from the elevator information and the general information, interrupts, when a predetermined display interruption factor occurs during the display of the general information, the display of the general information concerned, and displays the elevator information in the information display section; a display state administration section which determines whether or not the general information having been displayed in the information display section has finished being displayed to the end of the information display unit; and a redisplay determination section which determines, when the display of the general information has been interrupted, based on the display interruption factor relating to the interruption and the result of the determination made by the display state administration section, whether or not the redisplay of the interrupted general information is necessary, wherein the information display control section redisplays the general information, which has been determined to be necessary to be redisplayed by the redisplay determination section, in the information display section from the beginning of the information display unit.

Advantageous Effects of Invention

The elevator information display device in accordance with the present invention achieves an effect that the offering of general information to users can be prevented from being omitted, and the dissatisfaction that may be felt by the user on account of the interruption of display of general information can be lightened.

DESCRIPTION OF EMBODIMENTS

First Embodiment

Figure 1:
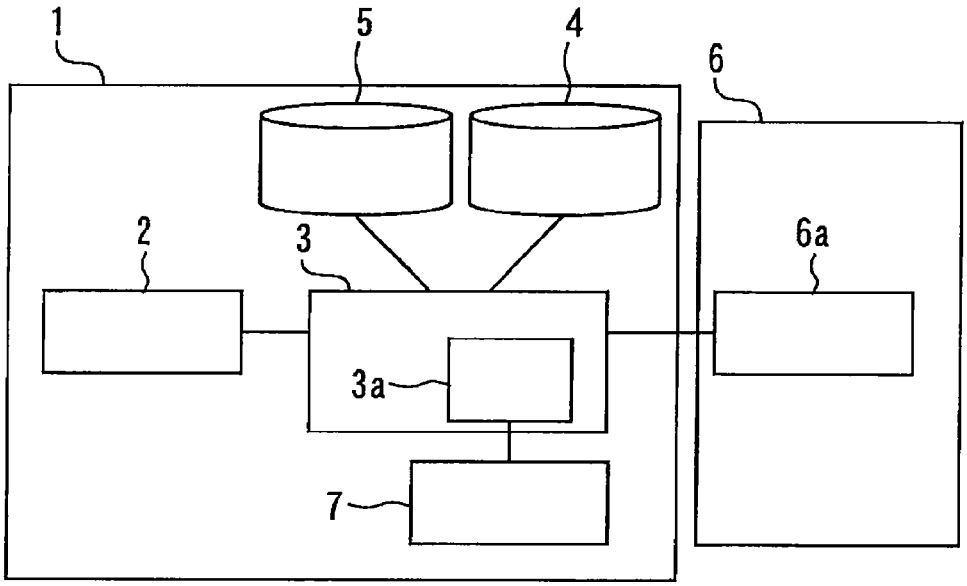
FIG. 1 is a block diagram showing the general configuration of an elevator information display device relating to a first embodiment of the present invention.
Figure 2:
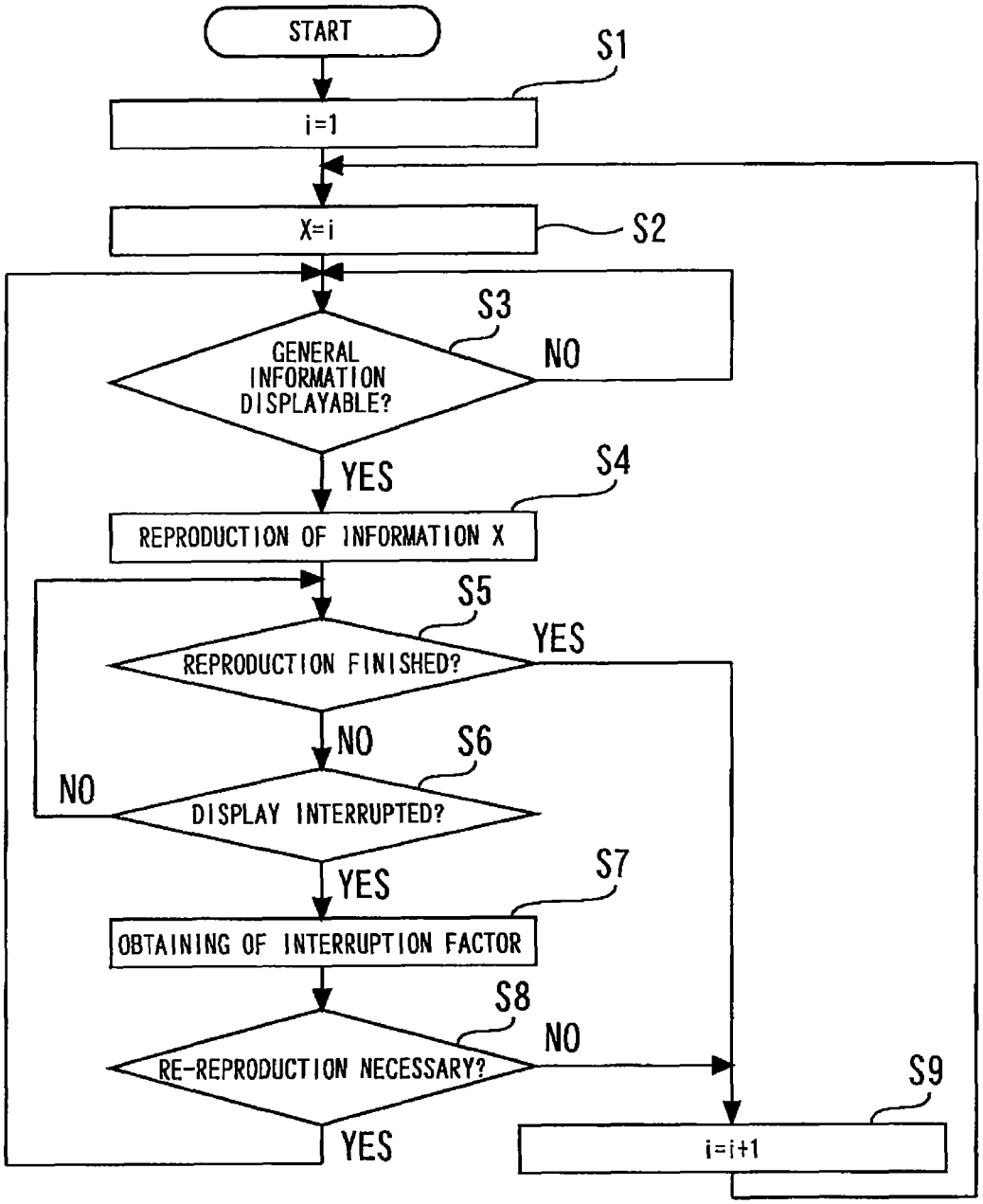
FIG. 2 is a flowchart showing the operation of the elevator information display device relating to the first embodiment of the present invention.

FIGS. 1 and 2 relate to a first embodiment of the present invention. FIG. 1 is a block diagram showing the general configuration of an elevator information display device, and FIG. 2 is a flowchart showing the motion of the elevator information display device.

In FIG. 1, reference sign 1 denotes an information display device body installed in at least one of a hall and a car, not shown, of an elevator. This information display device body 1 is provided with an information display section 2 for reproducing and displaying various kinds of information for elevator users. This information display section 2 is configured, for example, by a liquid crystal display (LCD).

The information reproduced and displayed in the information display section 2 is broadly divided into elevator information concerning the operation state of the elevator concerned and general information that does not relate directly to the elevator concerned. The elevator information includes information concerning control operation (for example, fire emergency return operation, or earthquake emergency return operation) of the elevator concerned, car arrival information, information for calling user's attention to door opening/closing motion, and the like information. The general information includes current news, weather forecasts, commercial messages, and the like. In particular, concerning the information belonging to the general information, an information display unit, such that one item of news, weather forecasts of one district, one item of commercial message, or the like is one unit, is set.

The kind (elevator information or general information) of information reproduced and displayed in the information display section 2 and the concrete contents of displayed information are selected and controlled by an information display control section 3 provided in the information display device body 1. The elevator information and general information reproduced and displayed in the information display section 2 are stored in an elevator information storage section 4 and a general information storage section 5, respectively, provided in the information display device body 1.

The elevator information stored in the elevator information storage section 4 is controlled in an elevator information control section 6*a* of an elevator control device 6 that controls the whole of operation of the elevator concerned. Therefore, the information display control section 3 obtains the elevator information to be displayed in the information display section 2 from the elevator information control section 6*a*, and stores it in the elevator information storage section 4 as necessary. Also, the general information stored in the general information storage section 5 is obtained via communications network such as the internet from general information sources and updated.

The information display control section 3 selects, under predetermined conditions, the information kind to be displayed in the information display section 2, obtains the information of the selected information kind from the elevator information storage section 4 or the general information storage section 5, and controls the display contents of the information display section 2 so that the obtained information is displayed in the information display section 2.

Hereunder is described in detail the predetermined conditions of determination about the display contents of the information display section 2, which is made in the information display control section 3. From the elevator information control section 6*a* of the elevator control device 6, elevator state information concerning the state of the elevator concerned is delivered (among these pieces of elevator state information, the information to be displayed in the information display section 2 is used as the aforementioned elevator information). Based on the elevator state information sent from the elevator information control section 6*a*, the information display control section 3 selectively determines the information kind, the contents, and display mode of information displayed in the information display section 2.

First, based on the elevator state information, the information display control section 3 determines whether the general information can be displayed. In this determination, conditions can be set so that during the door opening/closing motion, the display for guiding the door opening and closing is given priority and the display of general information is prohibited, or during the control operation, the display of control operation is given priority and the display of general information is prohibited. Also, as the condition as to whether general information can be displayed, the time period, the running state (during running or during stopping) of the elevator, and the like can also be set.

If, by this determination, it is determined that general information can be displayed, the information display control section 3 selectively determines which information of the general information is displayed, and transmits the selectively determined general information from the general information storage section 5 to the information display section 2. In the information display section 2, the general information transmitted from the information display control section 3 is displayed. The selection and transmission of this displayed information and the display in the information display section 2 are accomplished for each of the aforementioned information display units.

Since the amount of information capable of being displayed once in the information display section 2 is limited, in the case where information of one unit of information display units cannot be displayed once, the configuration is made such that by using scroll display or paging display, all pieces of information of one unit of information display units can be finally displayed in the information display section 2.

The information display device body 1 is provided with a display state administration section 7 for administrating the display state of general information in the information display section 2. This display state administration section 7 administrates the display state such that which degree of display of general information being displayed in the information display section 2 has been finished with the information display unit being a unit. When the display of one unit of information display units of information being presently displayed is finished, the display state administration section 7 transmits information display finish information to the information display control section 3.

When receiving the display finish information from the display state administration section 7, the information display control section 3 selects the information to be next reproduced and displayed successively and transmits it to the information display section 2, and this selected next information is reproduced and displayed in the information display section 2. Thus, as far as the condition that the general information can be displayed is met, when one (one unit of) general information is finished, the next information is displayed successively, and the display of general information is continued consecutively.

The information display control section 3 always monitors the elevator state information transmitted from the elevator information control section 6*a*. During the reproduction and display of general information, when the condition that the general information can be displayed comes to be not met (when the general information becomes unable to be displayed), the display of general information being reproduced and displayed is interrupted. This interruption of reproduction and display of general information is accomplished, for example, by merely stopping the transmission of general information from the information display control section 3 to the information display section 2, or by starting the transmission of elevator information from the information display control section 3 to the information display section 2 to overwrite the display contents in the information display section 2 by the display contents of the elevator information.

The information display control section 3 is provided with a redisplay determination section 3*a* that determines whether or not the interrupted general information need to be reproduced again (redisplayed) when the reproduction and display of general information are interrupted. When the reproduction and display of general information are interrupted, that is, when it is determined, based on the elevator state information, that the reproduction and display of general information are unable, this redisplay determination section 3*a* determines whether or not the redisplay of this general information is necessary from the determination as to whether or not, concerning the general information being reproduced and displayed, the display finish information has been received from the display state administration section 7.

Specifically, in the case where, when the reproduction and display of general information become unable, concerning the general information being reproduced and displayed, the display finish information has not been received from the display state administration section 7, it is determined that the redisplay of this general information is necessary, and inversely, in the case where the display finish information has been received, it is determined that the redisplay of this general information is unnecessary.

Also, in the determination as to whether or not the redisplay is necessary, which is made by the redisplay determination section 3*a*, a display interruption factor such that what factor has caused the interruption of general information may be further considered. As a concrete example of redisplay determination considering this display interruption factor, it is thought of a determination as to whether or not redisplay is further accomplished depending on the presence of a user in the car at the time of display interruption, the determination being made in the case where the display of general information has been interrupted, for example, to perform door opening/closing motion (to preferentially display the elevator information of door opening/closing) (in this case, it is determined that when a user is present, the redisplay is necessary, and when no user is present, the redisplay is unnecessary).

That is, the redisplay of information should be accomplished for a user the offering of information to whom has been hindered by an interruption factor such as a change of elevator state although the user has been seeing the general information at the time of interruption of display of general information. In other words, in the case where a user who has been seeing the general information at the time of interruption of display of general information is absent, the redisplay of information need not be accomplished. Therefore, by determining whether or not the redisplay is necessary considering the display interruption factor as described above, unnecessary redisplay operation is restrained, and information can be offered properly to a user truly requiring redisplay.

Concerning the case where the display of general information is interrupted by the transfer of elevator operation state to a control operation state such as fire, it is assumed that there is no user who continues to see the display before and after the display interruption. Therefore, in the case where the display interruption factor is the transfer to control operation, the condition has only to be set so that it is determined that the redisplay of information is unnecessary.

In the case where general information that is determined by the redisplay determination section 3*a* to be required to be redisplayed is present, the information display control section 3 transmits again the general information that is determined to require redisplay to the information display section 2 from the forefront of information when it is determined, based on the elevator state information, that the reproduction and display of general information can be accomplished, and in the information display section 2, the general information concerned is redisplayed from the forefront thereof.

In this embodiment, the elevator information display device operates according to the flowchart of FIG. 2.

First, in Step S1, a counter variable i for general information display is initialized, that is, 1 is substituted for i. Then, in Step S2, the value of i is substituted for a variable X for identifying a plurality of pieces of general information.

As described before, for the general information, the information display unit is set. Therefore, in the general information storage section 5, n number of general information from information 1 to information n (n is a natural number) are stored by being distinguished for each information display unit. The variable X in Step S2 is used to designate one of the plurality of pieces of general information distinguished by the information display unit, and the X (X=1, 2, . . . , n)-th information is referred to as information X.

In Step S3, the information display control section 3 determines, based on the elevator state information sent from the elevator information control section 6*a*, whether or not general information can be displayed. If it is determined that general information can be displayed, the process proceeds to Step S4. In Step S4, the information display control section 3 obtains information X from the general information storage section 5 and transmits it to the information display section 2. In the information display section 2, information X is reproduced and displayed.

In Step S5, the information display control section 3 checks whether or not, concerning information X, the display finish information has been received from the display state administration section 7. If it is checked that the display finish information has been received and the reproduction and display of information X have been finished, the process proceeds to Step S9, where the variable i is incremented, and the process returns to Step S2.

On the other hand, if the display finish information has not been received and the reproduction and display of information X have not been finished in Step S5, the process proceeds to Step S6. In Step S6, the information display control section 3 determines, based on the elevator state information sent from the elevator information control section 6, whether or not the reproduction and display of general information are interrupted. If it is determined that the reproduction and display of general information are not interrupted, the process returns to Step S5 while the reproduction and display of information X are continued. On the other hand, if it is determined that the reproduction and display of general information are interrupted, the reproduction and display of information X are interrupted, and the process proceeds to Step S7.

In Step S7, the information display control section 3 obtains a display interruption factor leading to the interruption of reproduction and display. Then, the process proceeds to Step S8, where the information display control section 3 determines, based on the obtained display interruption factor, whether or not the redisplay (re-reproduction) of information X is necessary.

If the redisplay (re-reproduction) of information X is necessary, the process returns to Step S3. When the state in which general information can be displayed comes to be formed, in Step S4, the information X is reproduced and displayed again from the forefront thereof (since variables i and X are not changed, the same information X is redisplayed). On the other hand, if it is determined, in Step S8, that the redisplay (re-reproduction) of information X is unnecessary, in Step S9, variable i is incremented, and the process returns to Step S2.

In the case where, as the result of increment of variable i in Step S9, the value of i exceeds the information display unit number n stored in the general information storage section 5, 1 is substituted for the value of i so that the contents of information to be displayed is looped.

The elevator information display device configured as described above includes the information display control section that selects, based on the state of elevator, information to be displayed in the information display section from the elevator information and the general information, interrupts, when a predetermined display interruption factor occurs during the display of the general information, the display of the general information concerned, and displays the elevator information in the information display section; the display state administration section that determines whether or not the general information having been displayed in the information display section has finished being displayed to the end of the information display unit; and the redisplay determination section that determines, when the display of the general information has been interrupted, based on the display interruption factor relating to the interruption and the result of the determination made by the display state administration section, whether or not the redisplay of the interrupted general information is necessary. The information display control section redisplays the general information, which has been determined to be necessary to be redisplayed by the redisplay determination section, again in the information display section from the beginning of the information display unit.

Therefore, by redisplaying the general information whose display has been interrupted during the display, many pieces of general information can be offered reliably to the users, and the offering of general information can be prevented from being omitted without the hindrance caused by the display of elevator information and without spoiling ease of seeing of display. Also, the dissatisfaction that may be felt by the user on account of the interruption of display of general information can be lightened, and also the redisplay of wasteful general information is prevented by the determination as to whether or not the general information is redisplayed, which is made by the factor leading to the interruption of display, and thereby general information can be offered to the users more properly and efficiently.

Second Embodiment

Figure 3:
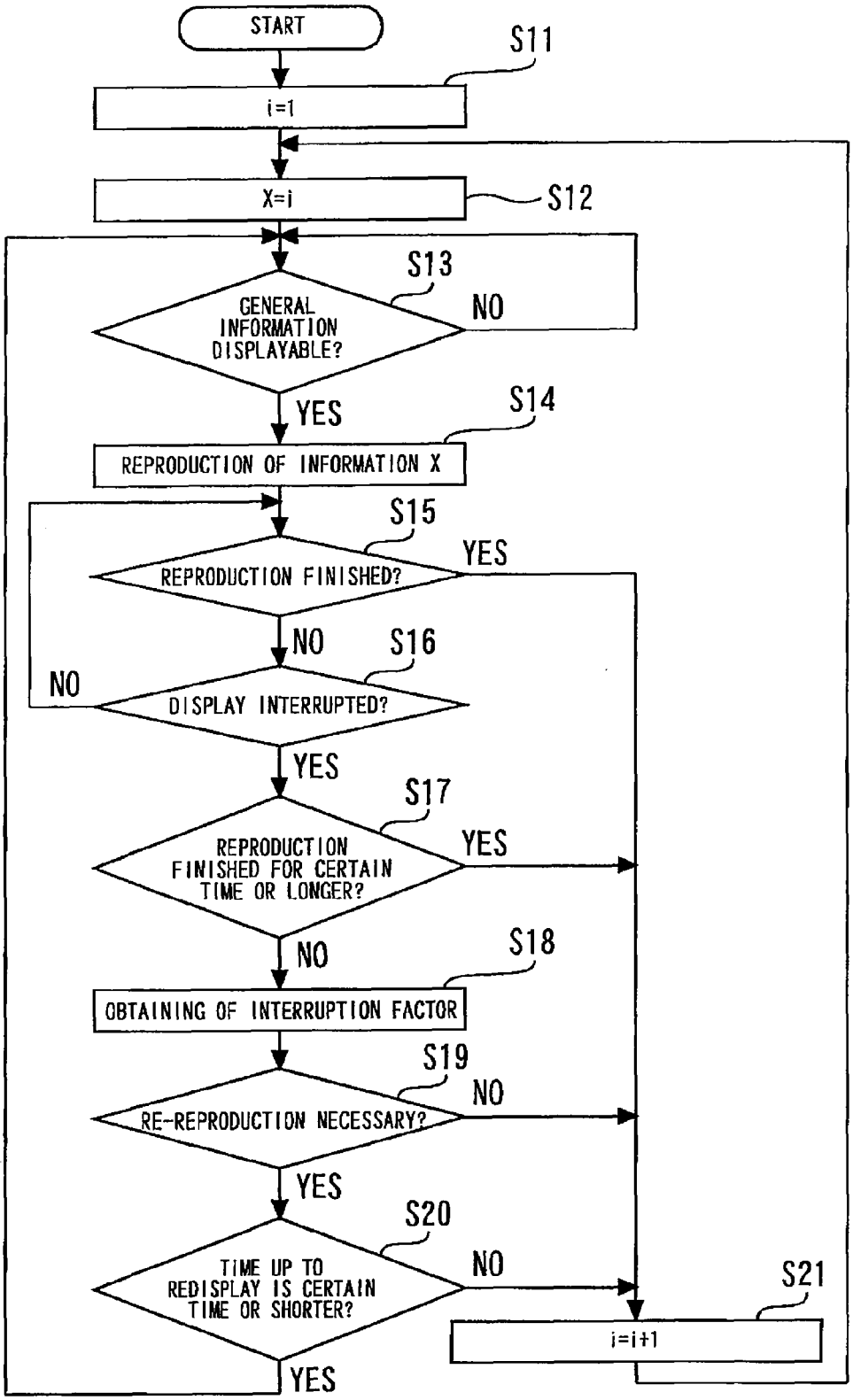
FIG. 3 is a flowchart showing the operation of the elevator information display device relating to a second embodiment of the present invention.

FIG. 3 is a flowchart showing the operation of the elevator information display device in accordance with a second embodiment of the present invention.

The second embodiment explained hereunder incorporates, in addition to the above-described configuration of the first embodiment, the elapsed time from when the display of certain information is started to when the display of the information concerned is interrupted, or the elapsed time from when the display of information is interrupted to when the information is redisplayed (the display of general information is enabled) in the determination conditions of information redisplay in the redisplay determination section.

That is, in the case where the reproduction and display of certain general information are interrupted, when the elapsed time from when the reproduction and display of the general information concerned are started to when the reproduction and display thereof are interrupted is not shorter than predetermined first redisplay determination time, the redisplay determination section 3*a* of the information display control section 3 determines that the redisplay of the general information concerned is unnecessary.

Concerning this predetermined first redisplay determination time, the same value may be set for all information display units of general information, or the configuration may be made such that an optional value can be set for each information display unit. Also, in the case where the time necessary for displaying all of one unit of each information display unit is clear, the first redisplay determination time may be set by the ratio in which the display for one unit of information display units has been finished (for example, redisplay is not accomplished if the display of ½ unit or larger of the information display unit has been finished).

By setting such a condition, for example, in the case where the state in which the display time of general information cannot be assured sufficiently continues, the information display device can be prevented from running into such a state that only the same information is repeatedly reproduced, and any other piece of information is not displayed for considerably long time.

Also, in the case where the reproduction and display of general information are interrupted, when the display of general information does not become able before predetermined second redisplay determination time has elapsed from this interruption, the redisplay determination section 3*a* determines that the redisplay of general information is unnecessary. By setting such a condition, in the case where, as the general information, timely information that is updated in succession according to the situation, information having strong prompt-reporting property, and the like information is being displayed, wasteful redisplay in the state in which the display timing is missed can be prevented.

Other configurations are the same as those of the first embodiment, and the detailed explanation thereof is omitted.

In this embodiment, the elevator information display device operates according to the flowchart of FIG. 3.

Steps S11 to S16 in FIG. 3 are the same as Steps S1 to S6 in FIG. 2 of the first embodiment, and therefore the explanation thereof is omitted. Also, Steps S18, S19 and S21 in FIG. 3 are the same as S7, S8 an S9 in FIG. 2, and therefore the explanation thereof is omitted.

If it is determined, in Step S16 of FIG. 3, that the reproduction and display of general information are interrupted, the reproduction and display of information X are interrupted, and the process proceeds to Step S17. In Step S17, the redisplay determination section 3*a* determines whether or not information X whose reproduction and display have been interrupted has been reproduced and displayed for certain time (predetermined first redisplay determination time) or longer from when the reproduction and display have been started to when the reproduction and display have been interrupted in Step S16.

In this determination, if information X has been reproduced and displayed for the predetermined first redisplay determination time or longer, in Step S21, variable i is incremented, and the process returns to Step S12. On the other hand, if the time for which information X has been reproduced and displayed is shorter than the predetermined first redisplay determination time, the process proceeds to Step S18. In Step S18, a display interruption factor is obtained, and thereafter if it is determined, in Step S19, based on the display interruption factor, that the redisplay (re-reproduction) of information X is necessary, the process proceeds to Step S20.

In Step S20, the redisplay determination section 3*a* determines whether or not the time from when the reproduction and display of general information have been interrupted to when the redisplay is started is certain time (predetermined second redisplay determination time) or shorter. If the time until redisplay is not the predetermined second redisplay determination time or shorter, that is, if the predetermined second redisplay determination time has elapsed from when the reproduction and display of general information have been interrupted to when the display of general information has been enabled again, the process proceeds to Step S21, where variable i is incremented, and thereafter the process returns to Step S12.

On the other hand, if the time until redisplay is the predetermined second redisplay determination time or shorter, the process returns to Step S13 and thereafter proceeds to Step S14, where information X is reproduced and displayed again from the forefront thereof.

The configuration may be such that by using at least either one of the condition using the first redisplay determination time, which has explained before, and the condition using the second redisplay determination time, it is determined whether or not the redisplay is necessary.

The elevator information display device configured as described above can achieve effects same as those of the first embodiment. In addition, in the case where the state in which the display time of general information cannot be assured sufficiently is continued, for example, when the display of general information is interrupted at the time of door opening/closing and the service floors are many, the information display device of the second embodiment is prevented from running into a state in which only the same information are repeatedly reproduced, and other pieces of information are not displayed.

Also, in the case where timely information that is updated in succession according to the situation or the like information is being displayed as general information, in such a situation that a considerable degree of time has elapsed from the display interruption, and it is seemed that the necessity for redisplay of information is low, unnecessary redisplay can be prevented, and information can be offered efficiently. Also, the user dissatisfaction caused by the display of meaningless information can be reduced.

INDUSTRIAL APPLICABILITY

The present invention can be used for an elevator information display device that displays elevator information and general information, which is divided into information display units, in an information display section.

DESCRIPTION OF SYMBOLS

1 information display device body
2 information display section
3 information display control section
3*a* redisplay determination section
4 elevator information storage section
5 general information storage section
6 elevator control device
6*a* elevator information control section
7 display state administration section

The invention claimed is:

1. An elevator information display device which displays elevator information and general information, which is divided into information display units, in an information display section, comprising:

an information display control section which selects, based on the state of an elevator, information to be displayed in the information display section from the elevator information and the general information, interrupts, when a predetermined display interruption factor occurs during the display of the general information, the display of the general information concerned, and displays the elevator information in the information display section;

a display state administration section which determines whether or not the general information having been displayed in the information display section has finished being displayed to the end of the information display unit; and a redisplay determination section which determines, when the display of the general information has been interrupted, based on the display interruption factor relating to the interruption and the result of the determination made by the display state administration section, whether or not the redisplay of the interrupted general information is necessary, wherein the information display control section redisplays the general information, which has been determined to be necessary to be redisplayed by the redisplay determination section, in the information display section from the beginning of the information display unit.

2. The elevator information display device according to claim 1, wherein, in the case where the general information is displayed for predetermined first redisplay determination time or longer from the beginning of the information display unit before the display of the general information is interrupted, the redisplay determination section determines that the redisplay of the general information concerned is unnecessary.

3. The elevator information display device according to claim 2, wherein the predetermined first redisplay determination time is set as a ratio to the information display unit for each of the information display units of the general information.

4. The elevator information display device according to claim 1, wherein, in the case where the general information is not displayed for predetermined second redisplay determination time or longer after the display of the general information has been interrupted, the redisplay determination section determines that the redisplay of the general information concerned is unnecessary.

5. The elevator information display device according to claim 2, wherein, in the case where the general information is not displayed for predetermined second redisplay determination time or longer after the display of the general information has been interrupted, the redisplay determination section determines that the redisplay of the general information concerned is unnecessary.

6. The elevator information display device according to claim 3, wherein, in the case where the general information is not displayed for predetermined second redisplay determination time or longer after the display of the general information has been interrupted, the redisplay determination section determines that the redisplay of the general information concerned is unnecessary.

7. The elevator information display device according to claim 1, wherein, in the case where the display interruption factor is control operation of elevator, the redisplay determination section determines that the redisplay of the general information is unnecessary.

8. The elevator information display device according to claim 2, wherein, in the case where the display interruption factor is control operation of elevator, the redisplay determination section determines that the redisplay of the general information is unnecessary.

9. The elevator information display device according to claim 3, wherein, in the case where the display interruption factor is control operation of elevator, the redisplay determination section determines that the redisplay of the general information is unnecessary.

10. The elevator information display device according to claim 1, wherein, in the case where the display interruption factor is elevator door opening/closing, and no user is present in a car, the redisplay determination section determines that the redisplay of the general information is unnecessary.

11. The elevator information display device according to claim 2, wherein, in the case where the display interruption factor is elevator door opening/closing, and no user is present in a car, the redisplay determination section determines that the redisplay of the general information is unnecessary.

12. The elevator information display device according to claim 3, wherein, in the case where the display interruption factor is elevator door opening/closing, and no user is present in a car, the redisplay determination section determines that the redisplay of the general information is unnecessary.

* * * * *